US006139136A

United States Patent [19]

Mackay et al.

[11] Patent Number: 6,139,136

[45] Date of Patent: Oct. 31, 2000

[54] INK SUPPLY SYSTEM INCLUDING A MULTIPLE LEVEL INK RESERVOIR FOR INK JET PRINTING

[75] Inventors: Donald G. Mackay, Roxbury; James A. Salomon, Cheshire; David B. Wilk, Clinton, all of Conn.

[73] Assignee: Pitney Bowes Inc., Stamford, Conn.

[21] Appl. No.: 08/992,198

[22] Filed: Dec. 17, 1997

[51] Int. Cl.[7] ..... B41J 2/175

[52] U.S. Cl. ..... 347/85

[58] Field of Search ..... 347/28, 30, 35, 347/85, 86, 87, 89, 7

[56] References Cited

U.S. PATENT DOCUMENTS

| | | | |
|---|---|---|---|
| 4,050,078 | 9/1977 | Isayama et al. | 347/7 |
| 4,282,536 | 8/1981 | Paschen et al. | 346/140.1 |
| 4,340,896 | 7/1982 | Cruz-Uribe et al. | 347/85 |
| 4,558,326 | 12/1985 | Kimura et al. | 347/30 |
| 4,677,448 | 6/1987 | Mizusawa et al. | 347/85 |
| 4,694,307 | 9/1987 | Toganoh et al. | 347/85 |
| 4,727,378 | 2/1988 | Le et al. | 347/35 |
| 5,185,614 | 2/1993 | Courian et al. | 347/24 |
| 5,485,187 | 1/1996 | Okamura et al. | 347/85 |
| 5,574,490 | 11/1996 | Gragg et al. | 347/87 |

FOREIGN PATENT DOCUMENTS 327925 4/1930 United Kingdom .

*Primary Examiner*—N. Le
*Assistant Examiner*—Michael Nguyen
*Attorney, Agent, or Firm*—Alberta A. Vitale; Michael E. Melton

[57] ABSTRACT

An ink supply system for a plurality of ink jet printheads offset from each other at different elevations includes an ink reservoir having a single outer casing and a plurality of individual ink wells inside of the casing, the plurality of individual ink wells arranged in a stepped relationship from each other and extending from a first ink well at a highest elevation to a last ink well at a lowest elevation, each of the plurality of individual ink wells supplying ink to and being lower in elevation than a corresponding one of the plurality of ink jet printheads for the purpose of controlling the negative pressure applied to the printheads to properly control the meniscus position at the nozzles for proper operation of the printheads; an ink supply having ink stored therein; and structure for supplying ink to the first ink well. The ink supply system operates such that at times when any specific one of the plurality of individual ink wells except for the last ink well receives an amount of ink greater than its capacity excess ink overflows out of the specific one of the plurality of individual ink wells and into an adjacent one of the plurality of individual ink wells which is lower in elevation than the specific one of the plurality of individual ink wells, and at times when the last ink well receives the amount of ink greater than its capacity excess ink overflows out of the last ink well and is returned into the ink supply.

14 Claims, 3 Drawing Sheets

INK SUPPLY SYSTEM INCLUDING A MULTIPLE LEVEL INK RESERVOIR FOR INK JET PRINTING

BACKGROUND

The use of hydrostatic pressure control at the nozzles of ink jet printheads has been utilized to effectively maintain an ink meniscus in each nozzle. The importance of maintaining such meniscus is to ensure that, after the printhead has been energized to eject drops of ink, a column of ink remains between the ink channels within the printhead and the printhead nozzles. If such column of ink is not maintained, air will enter the ink delivery system negatively impacting the ability of the printhead to print. If the ink reservoir were simply positioned above the nozzles, a column of ink would be maintained, but the positive hydrostatic pressure created at the nozzles would cause the ink to drip out. Accordingly, ink delivery systems which maintain a negative pressure at the printhead nozzles have been developed. The negative pressure on the supply side of the nozzles, if properly regulated within predetermined parameters, is sufficient to ensure that an ink meniscus which forms in the nozzles remains in place taking into account the viscosity and specific gravity of the particular ink.

One way in which such negative pressure is maintained is through the use of ink jet cartridges having a foam insert in the ink reservoir. This type of ink supply device can be mounted above the level of the printhead nozzles because a negative pressure at the nozzles is maintained the capillary action of the ink in the foam. However, this type of system is typically used in small ink volume situations.

Alternatively, it is known to position the ink reservoir below the vertical level of the printhead nozzles to maintain the desired negative pressure at the printhead nozzles. Basic hydrostatic pressure principles apply such that the relative position of the free surface of ink in the ink reservoir to the nozzles determines the resulting negative hydrostatic pressure at the nozzles. In these systems when the nozzles are energized to eject ink, additional ink is drawn from the reservoir by capillary action into the ink channels of the printhead. After energization of the printhead has ended, the controlling of the negative hydrostatic pressure at the nozzles correspondingly controls the meniscus position at the nozzles to ensure proper operation of the printhead.

It is also known to use ink jet printing systems in mail handling systems such as the postage cancellation device described in United States Application entitled "POSTAL CANCELLATION MACHINE" and filed on Oct. 03, 1997 under Attorney Docket No. E-663. In the aforementioned postage cancellation machine, multiple printheads are needed in order to print various size cancellation marks on different sized mailpieces being processed through the cancellation machine. Moreover, since the mailpieces are transported on edge and the various size cancellation marks differ in height along the vertical dimension of the transported mailpieces, each of the plurality of printheads are offset from each other in the vertical direction in order to selectively energize the printheads for printing large and small cancellation marks. However, since the operating parameters of each printhead are the same, the negative pressure at each printhead must be maintained within a desired range taking into account the difference in hydrostatic pressure resulting from the different printhead elevations. The hydrostatic pressure control principles discussed above can be used to maintain the desired negative pressure by providing each printhead with its own ink delivery system. However, the use of multiple independent ink delivery systems drives up the cost of the product and lowers its expected reliability.

SUMMARY OF THE INVENTION

It is thus an object of the invention to provide an ink supply system which maintains a hydrostatic pressure within a predetermined range at the nozzles of each of a plurality of printheads offset from each other in the vertical direction.

The above object is met by providing an ink supply system for a plurality of ink jet printheads offset from each other at different elevations, the ink supply system including an ink reservoir having a single outer casing and a plurality of individual ink wells inside of the casing, the plurality of individual ink wells arranged in a stepped relationship from each other and extending from a first ink well at a highest elevation to a last ink well at a lowest elevation, each of the plurality of individual ink wells supplying ink to and being lower in elevation than a corresponding one of the plurality of ink jet printheads; an ink supply having ink stored therein; and structure for supplying ink to the first ink well; wherein at times when any specific one of the plurality of individual ink wells except for the last ink well receives an amount of ink greater than its capacity excess ink overflows out of the specific one of the plurality of individual ink wells and into an adjacent one of the plurality of individual ink wells which is lower in elevation than the specific one of the plurality of individual ink wells, and at times when the last ink well receives the amount of ink greater than its capacity excess ink overflows out of the last ink well and is returned into the ink supply.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
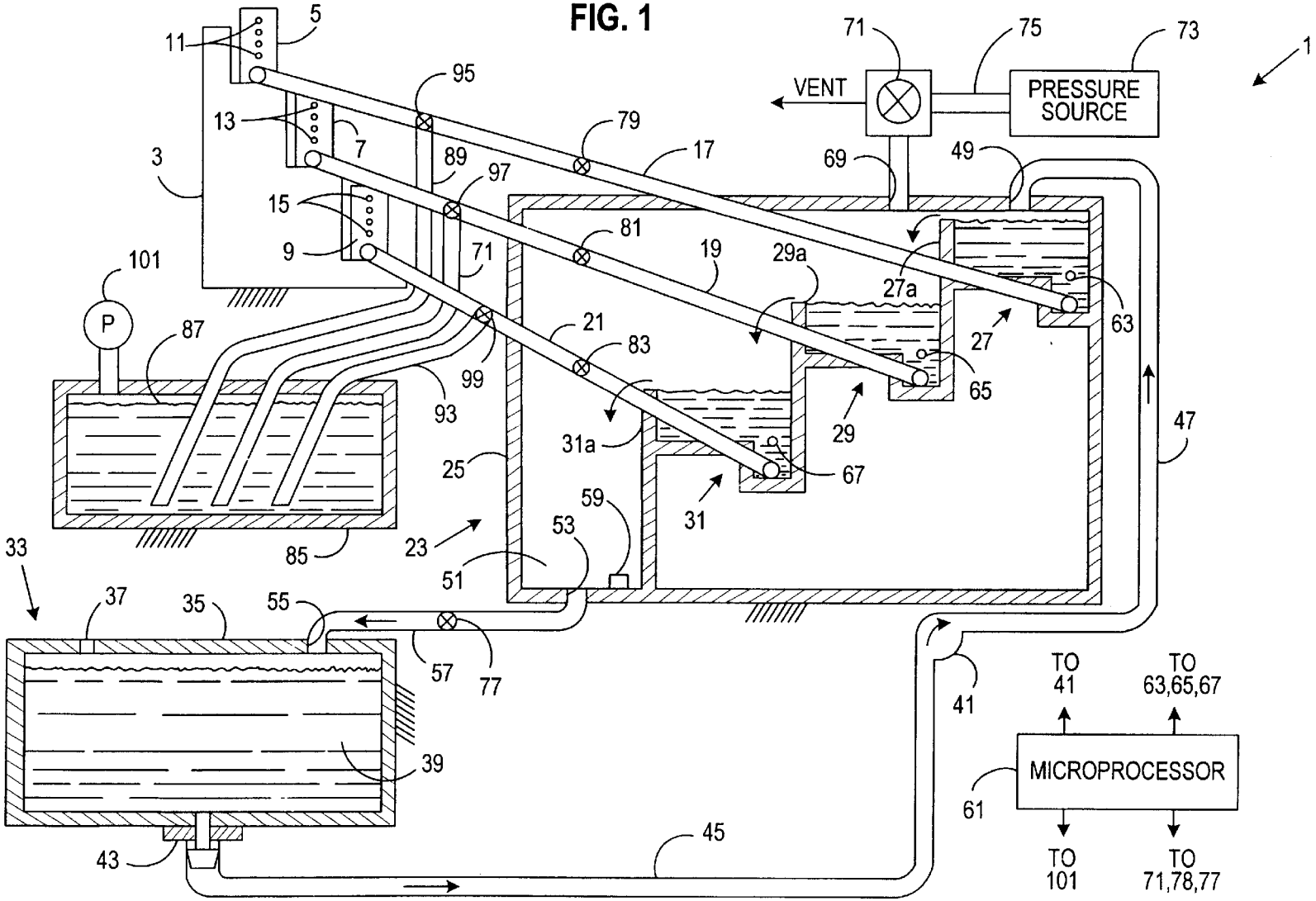
FIG. 1 is a schematic elevational view partly in section showing the inventive ink supply system.

Referring to FIG. 1, the inventive ink supply system is shown at 1. Although not shown, the ink supply system can be mounted in any device to accomplish printing, such as the aforementioned postage cancellation machine, as long as the relative relationships between the individual components of the ink supply system 1, which are discussed in more detail below, are maintained.

A platform 3, which is fixed in place, has three ink jet printheads 5, 7, and 9 mounted thereto which respectively have nozzles 11, 13, and 15 from which drops of ink are ejected upon command. Adjacent ones of the printheads 5, 7, and 9 are offset in the vertical direction from each other by approximately 14 millimeters. Each of the printheads 5, 7, and 9 are connected through respective tubes 17, 19, and 21 to a secondary ink supply reservoir 23 as discussed in more detail below.

Secondary ink supply reservoir 23 includes a sealed outer casing 25 and three separate ink wells 27, 29, and 31 formed therein. Adjacent ones of the ink wells 27, 29, and 31 are offset from each other by 14 millimeters. A primary ink supply reservoir 33 includes a sealed outer casing 35 having a vent 37. The primary ink supply reservoir 33 is filled with ink 39 to be supplied to secondary ink supply reservoir 23. That is, when a peristaltic pump 41 is activated, it draws the ink 39 out of the casing 35 and through a filter and sealing structure 43. The ink 39 is forced through first and second tube sections 45 and 47 and eventually delivered into ink well 27 via opening 49 in casing 25. When the secondary ink supply reservoir 23 is initially filled with ink, pump 41 is run for a predetermined period of time to ensure that all three ink wells 27, 29, and 31 are filled. That is, when the level of ink in ink well 27 begins to flow over the top of side wall 27*a*, it begins to fill up the next lower ink well 29. Similarly, when the ink level in ink well 29 flows over wall 29*a*, it flows into ink well 31. Likewise, when ink well 31 is filled, ink will flow over wall 31*a* into an ink catch basin 51. Ink catch basin 51 has an opening 53 in a lower bottom portion thereof which is in communication with an opening 55 in casing 35 of primary ink supply reservoir 33 via a tube 57. Thus, excess ink spilling over from ink well 31 is returned to primary ink supply reservoir 33 via tube 57. A thermistor 59 is positioned at the bottom of catch basin 51 to detect the presence or absence of ink such that when ink is detected thermistor 59 sends an indication of such to microprocessor 61 which in turn stops operation of pump 41 since the ink wells 27, 29 and 31 are filled to capacity.

During the energizing of printheads 5, 7, and 9, ink is drawn from the corresponding ink well 27, 29 and 31 to the nozzles 11, 13, and 15. Thus, the level of ink within each ink well 27, 29, and 31 will eventually get lower. Since the printheads are at a fixed position, the changing ink level will automatically change the hydrostatic pressure at the nozzles 11, 13, and 15. Moreover, since use of the individual printheads 27, 29, and 31 will vary depending on the images printed, the level of ink in each ink well 27, 29, and 31 relative to its corresponding printhead may be different for each printhead resulting in different negative pressures at each printhead. This difference in negative pressures at each printhead does not present a problem as long as the negative pressure at each of the printheads 27, 29, and 31 is regulated to fall within a predetermined range so that the ink meniscus is maintained at each nozzle. In the preferred embodiment the desired negative pressure range at each printhead should be maintained between approximately −10 to −40 millimeters of water pressure. This is accomplished by the fixed position of the printheads 5, 7, and 9 relative to the corresponding ink wells 27, 29 and 31 and the regulation of the ink level within each ink well 27, 29, and 31. That is, ink wells 27, 29, and 31 are each positioned so that when each of the ink wells 27, 29 and 31 are filled to capacity, the top surface of the ink in each ink well is approximately 25 millimeters from the vertical center of its corresponding printhead. Since each printhead 5, 7, and 9 is approximately 13 millimeters in height, the top and bottom nozzles of the vertical row of nozzles of each printhead 5, 7, and 9 are respectively 6.5 millimeters above and 6.5 millimeters below the vertical center. Thus, when each ink well 27,29, and 31 is filled to capacity, the top and bottom nozzles of their corresponding nozzles are respectively approximately 31.5 and 18.5 millimeters above the top surface of the ink in the corresponding ink well so that all of the nozzles are within the aforementioned desired negative pressure range.

As the printheads are used for printing, the level of ink in each ink well 27, 29 and 31 is gradually lowered. The lowering of the ink level automatically increases the negative pressure at each printhead. To ensure that this negative pressure is never greater than −40 millimeters of water pressure, each ink well 27, 29, and 31 has a thermistor 63, 65, and 67 respectively disposed therein at a level of approximately 5 millimeters below the surface of the ink at filled capacity. Accordingly, when the ink drops below the thermistor, a signal indicative thereof is received by the microprocessor 61 which begins pumping ink 39 into ink well 27. Microprocessor 61 will continue to pump ink 39 into ink well 29 for a predetermined period of time after the thermistor, (63, 65, or 67) which indicated a low ink level indicates that the ink level, has risen above it. Thus, when the microprocessor 61 stops operating the pump 41, the ink well which was low will be filled to capacity. This ink supply system is very simple and effective because of the cascading arrangement of the ink wells 27, 29, and 31. Moreover, in the above described arrangement, the ink wells 27, 29 and 31 are each maintained between maximum capacity and an ink level 5 millimeters below maximum capacity by a single ink supply and a single pump system. Additionally, since the level of ink in each ink well 27, 29, and 31 does not drop from capacity by more than 5 millimeters in vertical height, in the highest negative pressure scenario at the top and bottom nozzles of each printhead will respectively be 36.5 and 23.5 millimeters of water pressure.

While the above sets forth one type of structure for ensuring that an adequate ink level is maintained in each of ink wells 27, 29 and 31, other techniques can also effectively be utilized. For example, use of all of the thermistors 59, 67, 65, and 63 can be eliminated. In lieu thereof, the pump 41 can be energized to run any time the printheads 5, 7, and 9 are energized for printing. Since the ink supplied by pump 41 will always be greater than the ink ejected by the printheads 5, 7, and 9 over any concurrent period of time where they are both operating, the ink wells 27, 29, and 31 will always remain filled. Alternatively the level of ink in each ink well can be determined by counting the number of drops emitted by each printhead or the number of images printed and the pump 41 can be run for a period of time sufficient to fill all of the ink wells 27, 29, and 31 when one of the ink levels is determined to be below a threshold value.

Sealed outer casing 25 has a vent opening 69 connected to a two way valve 71. When valve 71 is in its normal first position its acts as a vent for the interior of outer casing 25. This vent ensures that a large negative pressure is not created as ink is drawn from secondary ink supply reservoir 23 by the energizing of printheads 5, 7, and 9. Conversely, at times it is desirable to purge the printhead nozzles 11, 13, and 15 for conventional maintenance purposes. Such purging is done by moving the two-way valve 71 to a second position thereby closing the vent. In the second position the valve 71 is connected to a pressure source 73 via tube 75. A solenoid activated pinch valve 77 which is normally in the open position to permit the free flow of ink from basin 51 to supply 33 is closed for the purging operation under the control of microprocessor 61. Then, the pressure source 73 is activated forcing ink out of the ink wells 27, 29, and 31 and through nozzles 11, 13, and 15. Additionally, each tube 17, 19, and 21 includes a thumb screw pinch valve 79, 81 and 83 attached thereto which are normally in a position to allow the free flow of ink through the associated tube. However, each pinch valve can be individually adjusted to seal off its associated tube thereby allowing individual purging of printheads 5, 7, and 9 as desired.

As part of the maintenance of the printheads 5, 7, and 9, it is often the case to periodically pump a flushing solution through the printhead nozzles to keep them free of contamination. Also, during extended periods of non-use the flushing solution is often used as a replacement for the ink in the printhead since it does not evaporate as quickly. Accordingly, a flushing solution reservoir 85 having flushing solution 87 stored therein is connected to tubes 17, 19, and 21 via tubes 89, 91, and 93. Three way valves 95, 97, and 99 respectively connect tubes 89, 91, and 93 to corresponding tubes 17, 19, and 21. Thus, by way of example, when valve 95 is in a first position, ink is supplied to printhead 5 through tube 17. However, when valve 95 is moved to a second position (either manually or under control of the microprocessor 61), only flushing solution can be supplied from reservoir 85 to printhead 5. That is, when valve 95 is in the second position a pressure source 101 can be energized to pressurize reservoir 85 through opening 103. This forces the flushing solution through tube 89, valve 95 and out of nozzles 11. By controlling operation of pump 101 a metered amount of flushing solution can be provided. The operation for supplying flushing solution to printheads 9 and 7 is accomplished in the same manner through their corresponding components.

In yet another embodiment, the reservoir 85 can have the same cascading ink well design as the secondary ink supply reservoir 23. However, instead of supplying ink, flushing fluid can selectively be supplied to the respective printheads 5, 7, and 9.

Figure 2:
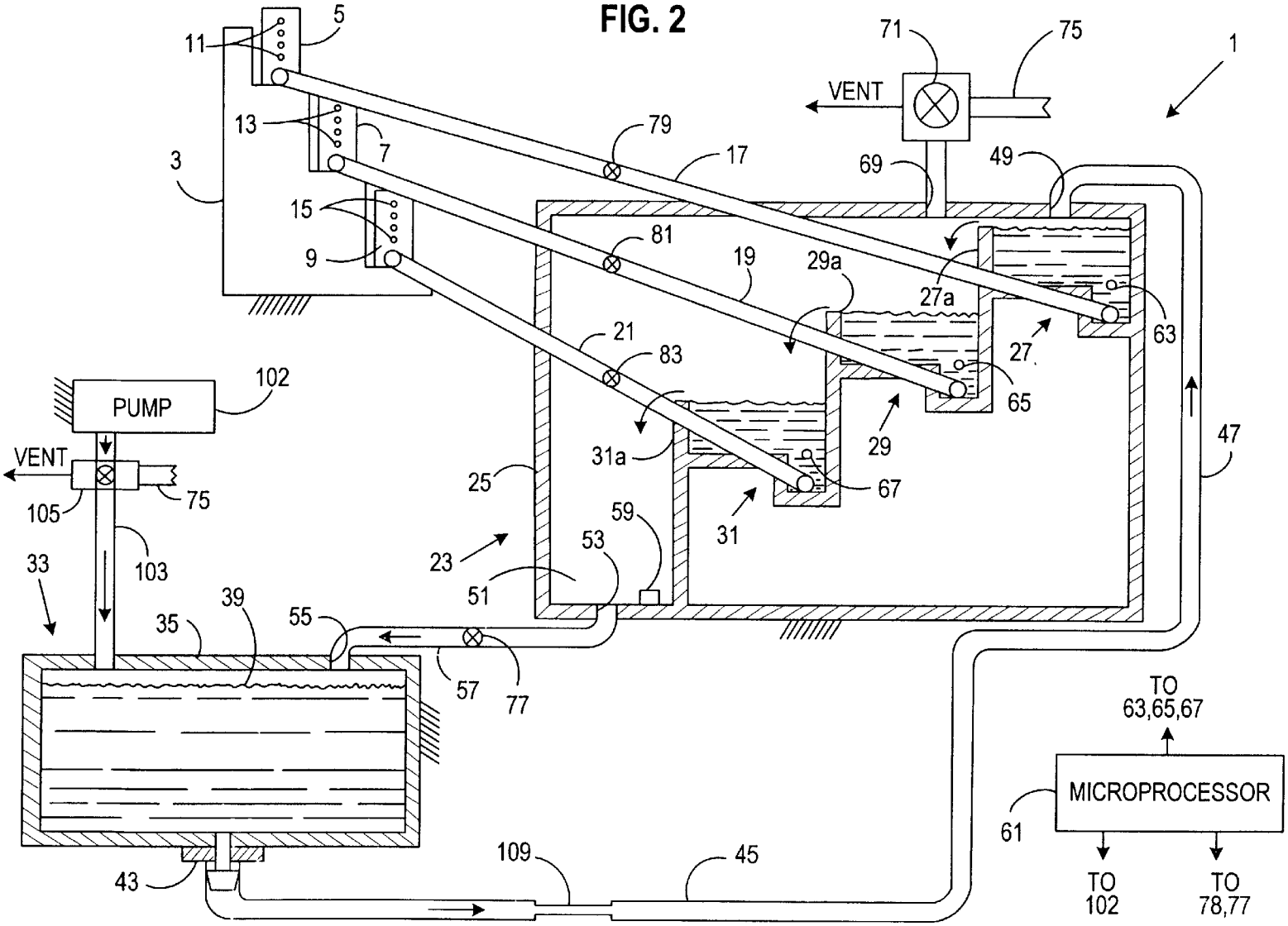
FIG. 2 is a second embodiment of the inventive ink supply system.

FIG. 2 shows a second embodiment of the inventive ink supply system. All components of the FIG. 2 structure having numerals the same as those of FIG. 1 operate in the same manner as the corresponding structure of FIG. 1 such that a discussion of those components is not repeated herein. FIG. 2 differs from FIG. 1 in that instead of using a peristaltic pump to fill the ink wells 27, 29, and 31, an air pump 102 is used. Furthermore, as discussed below, the air pump 102 is also used to accomplish a pressure purge of the printhead nozzles 11, 13, and 15.

For supplying ink 39 from the primary ink supply reservoir 33 to the ink wells 27, 29, and 31, pump 102 is connected to primary ink supply reservoir 33 via tube 103. Thus, when pump 102 is energized it pressurizes the interior of casing 35. Valve 77 is activated to close tube 57 such that ink 39 flows from primary ink supply reservoir 33 into secondary ink supply reservoir 23. However, since the air pump 102 differs from the peristaltic pump in that it pressurizes the system during ink delivery, structure has been incorporated to control the pressurization as well as to deliver the ink at a specified flow rate. A three way solenoid actuated valve 105 is positioned in line with tube 103 to 1) permit venting of the primary ink supply 33, 2) allow ink to be supplied from the primary ink supply 33 to the secondary ink supply 23 by providing a regulated pressure, and 3) permit purging of the nozzles depending upon the positioning of the three way valve. In a first position the air pressure from pump 102 is regulated by a 1.5 PSI pressure regulating valve 105 and pressurizes the primary ink supply reservoir 33 to deliver ink to the secondary ink supply reservoir 23. The specified flow rate of ink 39 supplied to the secondary ink supply reservoir 23 is achieved through the use of a restrictor in tube 45. In a second position the three way valve is open to a 0.010 inch vent to prevent too large a negative pressure from building up in primary ink supply reservoir 33 as ink is withdrawn therefrom during energizing of the printheads 5, 7, and 9. In a third position the air pressure from pump 102 is provided via tube 75 to valve 71 to accomplish the previously described pressure purge of nozzles 11, 13, and 15. When a purge of the nozzles 11, 13, and 15 is required, all of the pinch valves are closed and the pump 102 is turned on. The pinch valves 79, 81 and 83 can then be selectively opened to accomplish the desired purging.

Figure 3:
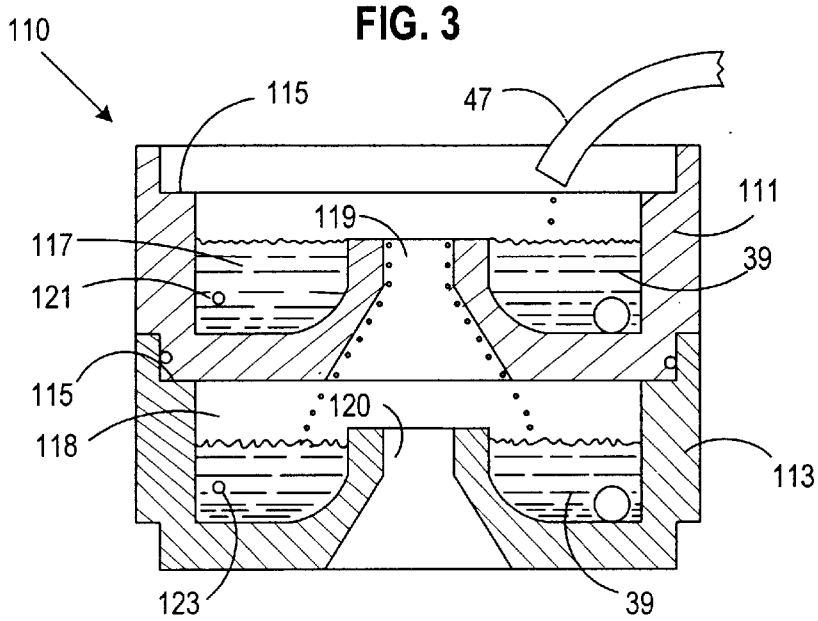
FIG. 3 is a cross-sectional view of another embodiment of a cascading ink reservoir in a stacked configuration.

FIG. 3 shows a cross-sectional view of a stacked reservoir structure 110 which can be used in lieu of the secondary ink supply reservoir 23 of FIGS. 1 and 2. Ink 39 is delivered from the primary ink supply reservoir 33 to a top ink reservoir 111 via tube 47 in the same manner as discussed in either FIGS. 1 or 2. Additionally, the ink 39 is delivered to the printheads 5 and 7 via tubes 17, 19 in the same manner as discussed above for FIGS. 1 and 2. The difference between the stacked reservoir 110 and secondary ink supply reservoir 23 is that instead of having ink wells laterally and vertically offset from each other, the ink wells 111 and 113 are vertically stacked on each other via interlocking corners 115. Each ink well 111 and 113 has a respective trough 117, 118 surrounding a central through opening 119, 120. Thus, as the ink 39 is delivered from tube 47 into the top ink well 111, it eventually reaches a point where it flows out of the trough and enters the opening 119. The ink passes through opening 119 and is deposited in the trough 118 of second ink well 113. Thus, the cascading ink filling associated with secondary ink supply reservoir 23 is also accomplished by the stacked reservoir configuration of FIG. 3. Thermistors 121 and 123 are also disposed in the ink wells 111, and 113 to regulate the need for ink refills as discussed in connection with FIG. 1. Additionally the two ink wells 111 and 113 have an o-ring seal at the interlocking corners.

While the structure of FIG. 3 only shows two ink wells 111 and 113, it is readily apparent that any number of ink well units can be stacked in this manner to provide ink for any corresponding number of printheads. The stacked arrangement provides a compact upright design which is easily reconfigurable for any number of ink wells needed. Moreover, the bottom ink well in the stack will have its through opening connected to primary ink supply reservoir 33 to return excess ink in the ink wells back to primary ink supply reservoir 33.

Figure 4:
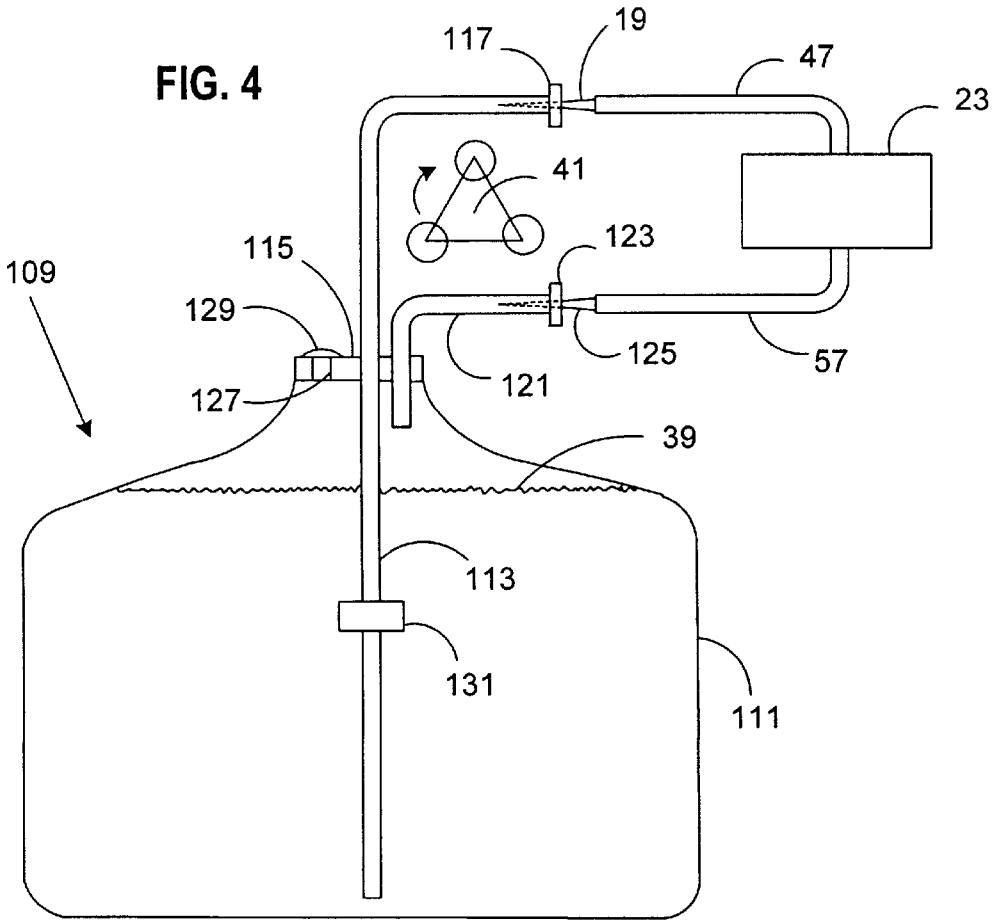
FIG. 4 is a schematic view of an alternate primary ink supply system.

FIG. 4 shows another embodiment of a primary ink supply reservoir system 109 which is designed for easy replacement. Reservoir system 109 includes a container 111 which contains ink 39 therein. A supply tube 113 extends through a first septum 115 and has a second septum 117 mounted at one end thereof. Septum 117 is penetrated by a needle 119 connected to tube 47 so that it provides a fluid passageway between the inside of tube 113 and tube 47. Additionally a return tube 121 extends through septum 115 at a first end thereof and is in fluid communication with tube 57 via a septum 123 and needle 125 arrangement. The reservoir system 109 can be shipped as a unit in three parts. The first is the container 111 without the tubes 113 and 121 inserted through the septum 115. The second and third parts are the tubes with corresponding septums 113/117 and 121/123. Thus when an operator receives the reservoir system 109 they insert the tubes 113/121 through septum 115 into the positions shown and connect the respective septums 117 and 123 to corresponding needles 119 and 125. This type of quick disconnect feature allows for easy replacement. Additionally, the septum 115 can have a through opening 127 which in shipment is sealed by a pull tab 129. In operation, the pull tab 129 is removed so that through opening 127 acts as a vent. Finally, a filter 131 is provided in line with tube 113 to screen out particulate from getting into the ink jet printing system.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims. For example, any type of quick disconnect can be used in lieu of the septum/needle structures shown in FIG. 4.

What is claimed is:

1. An ink supply system for a plurality of ink jet printheads offset from each other at different elevations, the ink supply system comprising:

an ink reservoir having a single outer casing and a plurality of individual ink wells inside of the casing, the plurality of individual ink wells arranged in a stepped relationship from each other and extending from a first ink well at a highest elevation to a last ink well at a lowest elevation, each of the plurality of individual ink wells being lower in elevation than a corresponding one of the plurality of ink jet printheads;

an ink supply having ink stored therein; and means for supplying ink from the ink supply to the first ink well;

means for connecting each of the plurality of individual ink wells to the corresponding one of the plurality of ink jet printheads such that during activation of the plurality of inkjet printheads ink is supplied from the corresponding ink well to its corresponding one of the plurality of ink jet printheads and during deactivation of the ink jet printheads ink is maintained between the plurality of ink jet printheads and the corresponding ones of the plurality of individual ink wells;

wherein at times when any specific one of the plurality of individual ink wells except for the last ink well receives an amount of ink greater than its capacity excess ink overflows out of the specific one of the plurality of individual ink wells and into an adjacent one of the plurality of individual ink wells which is lower in elevation than the specific one of the plurality of individual ink wells, and at times when the last ink well receives the amount of ink greater than its capacity excess ink overflows out of the last ink well and into the ink supply.

2. An ink supply system as recited in claim 1, wherein the supplying means includes a means for pumping ink from the ink supply to the first ink well and means for controlling operation of the pumping means.

3. An ink supply system as recited in claim 2, wherein each of the plurality of individual ink wells includes a sensor disposed therein which provides an indication to the controlling means when an ink level within the corresponding one of the plurality of individual ink wells has reached a predetermined elevation and the controlling means operates the pumping means to provide ink to the first ink well until the sensor indicates that the ink level has risen above the predetermined elevation and for a predetermined period of time thereafter.

4. An ink supply system as recited in claim 2, wherein the controlling means causes the pumping means to pump ink from the ink supply to the first ink well whenever any of the plurality of ink jet printheads are energized to print thereby ensuring that all of the plurality of ink wells remain in a filled condition.

5. An ink supply system for a plurality of ink jet printheads offset from each other at different elevations, the ink supply system comprising:

an ink reservoir having a single outer casing and a plurality of individual ink wells inside of the casing, the plurality of individual ink wells arranged in a stepped relationship from each other and extending from a first ink well at a highest elevation to a last ink well at a lowest elevation, each of the plurality of individual ink wells being lower in elevation than a corresponding one of the plurality of ink jet printheads;

an ink supply having ink stored therein;

means for supplying ink from the ink supply to the first ink well, the supplying means includes a means for pumping ink from the ink supply to the first ink well and means for controlling operation of the pumping means; and means for connecting each of the plurality of individual ink wells to the corresponding one of the plurality of ink jet printheads such that during activation of the plurality of inkjet printheads ink is supplied from the corresponding ink well to its corresponding one of the plurality of ink jet printheads and during deactivation of the ink jet printheads ink is maintained between the plurality of ink jet printheads and the corresponding ones of the plurality of individual ink wells;

wherein at times when any specific one of the plurality of individual ink wells except for the last ink well receives an amount of ink greater than its capacity excess ink overflows out of the specific one of the plurality of individual ink wells and into an adjacent one of the plurality of individual ink wells which is lower in elevation than the specific one of the plurality of individual ink wells, and at times when the last ink well receives the amount of ink greater than its capacity excess ink overflows out of the last ink well and into the ink supply; and wherein each of the plurality of individual ink wells includes a sensor disposed therein which provides an indication to the controlling means when an ink level within the corresponding one of the plurality of individual ink wells has reached a predetermined elevation and the controlling means operates the pumping means to provide ink to the first ink well for a predetermined time period sufficient to ensure that the corresponding one of the plurality of individual ink wells is filled above the predetermined level.

6. An ink supply system as recited in claim 5, wherein the predetermined time period is sufficient to ensure that all of the plurality of ink wells are filled to capacity.

7. An ink supply system as recited in claim 5, further comprising a flushing solution reservoir having flushing solution stored therein and means for selectively supplying flushing solution to the plurality of ink jet printheads in lieu of ink.

8. An ink supply system for a plurality of ink jet printheads offset from each other at different elevations, the ink supply system comprising:

an ink reservoir having plurality of individual ink wells vertically stacked one on top of the other from a bottom ink well to a top ink well, each of the plurality of individual ink wells being lower in elevation than a corresponding one of the plurality of ink jet printheads;

an ink supply having ink stored therein; and means for supplying ink from the ink supply to the top ink well;

means for connecting each of the Plurality of individual ink wells to the corresponding one of the plurality of ink jet printheads such that during activation of the plurality of inkjet printheads ink is supplied from the corresponding ink well to its corresponding one of the plurality of ink jet printheads and during deactivation of the ink jet printheads ink is maintained between the plurality of ink jet printheads and the corresponding ones of the plurality of individual ink wells;

wherein at times when any specific one of the plurality of individual ink wells except for the bottom ink well receives an amount of ink beyond its capacity excess ink overflows out of the specific one of the plurality of individual ink wells and into a next adjacent one of the plurality of individual ink wells which is lower in elevation than the specific one of the plurality of individual ink wells, and at times when the bottom ink well receives the amount of ink beyond its capacity excess ink overflows out of the bottom ink well and into the ink supply.

9. An ink supply system as recited in claim 8, wherein each of the plurality of individual ink wells includes a trough for storing ink therein and an opening around which the trough is disposed such that at times when excess ink overflows out of the trough it passes through the opening and into the trough of a next lower ink well except for the bottom ink well where excess ink overflows and returns to the ink supply.

10. An ink supply system as recited in claim 8, wherein the supplying means includes a means for pumping ink from the ink supply to the first ink well and means for controlling operation of the pumping means.

11. An ink supply as recited in claim 10, wherein each of the plurality of individual ink wells includes a sensor disposed therein which provides an indication to the controlling means when an ink level within the corresponding one of the plurality of individual ink wells has reached a predetermined elevation and the controlling means operates the pumping means to provide ink to the first ink well until the sensor indicates that the ink level has risen above the predetermined elevation and for a predetermined period of time thereafter.

12. An ink supply system for a plurality of ink jet printheads offset from each other at different elevations, the ink supply system comprising:

an ink reservoir having plurality of individual ink wells vertically stacked one on top of the other from a bottom ink well to a top ink well, each of the plurality of individual ink wells being lower in elevation than a corresponding one of the plurality of ink jet printheads;

an ink supply having ink stored therein;

means for supplying ink from the ink supply to the top ink well, the supplying means includes a means for pumping ink from the ink supply to the first ink well and means for controlling operation of the pumping means; and means for connecting each of the plurality of individual ink wells to the corresponding one of the plurality of ink jet printheads such that during activation of the plurality of inkjet printheads ink is supplied from the corresponding ink well to its corresponding one of the plurality of ink jet printheads and during deactivation of the ink jet printheads ink is maintained between the plurality of ink jet printheads and the corresponding ones of the plurality of individual ink wells;

wherein at times when any specific one of the plurality of individual ink wells except for the bottom ink well receives an amount of ink beyond its capacity excess ink overflows out of the specific one of the plurality of individual ink wells and into a next adjacent one of the plurality of individual ink wells which is lower in elevation than the specific one of the plurality of individual ink wells, and at times when the bottom ink well receives the amount of ink beyond its capacity excess ink overflows out of the bottom ink well and into the ink supply;

wherein each of the plurality of individual ink wells includes a trough for storing ink therein and an opening around which the trough is disposed such that at times when excess ink overflows out of the trough it passes through the opening and into the trough of a next lower ink well except for the bottom ink well where excess ink overflows and returns to the ink supply; and wherein each of the plurality of individual ink wells includes a sensor disposed therein which provides an indication to the controlling means when an ink level within the corresponding one of the plurality of individual ink wells has reached a predetermined elevation and the controlling means operates the pumping means to provide ink to the first ink well for a predetermined time period sufficient to ensure that the corresponding one of the plurality of individual ink wells is filled to above the predetermined level.

13. An ink supply system as recited in claim 12, wherein the predetermined time period is sufficient to ensure that all of the plurality of ink wells are filled to capacity.

14. An ink supply system as recited in claim 13, further comprising a flushing solution reservoir having flushing solution stored therein and means for selectively supplying flushing solution to the plurality of ink jet printheads in lieu of ink.

* * * * *